US006013014A

United States Patent [19]

Hern

[11] Patent Number: 6,013,014

[45] Date of Patent: Jan. 11, 2000

[54] COUCH EXERCISE APPARATUS

[76] Inventor: James L. Hern, 11051 103RD Terrace North, Largo, Fla. 33778

[21] Appl. No.: 09/228,602

[22] Filed: Jan. 12, 1999

[51] Int. Cl.[7] ..... A63B 21/02

[52] U.S. Cl. ..... 482/121; 482/124; 482/130; 482/904

[58] Field of Search ..... 482/121, 124, 482/130, 904, 125, 129, 122

[56] References Cited

U.S. PATENT DOCUMENTS

| | | | |
|---|---|---|---|
| 5,141,482 | 8/1992 | Hern | 482/130 |
| 5,362,296 | 11/1994 | Wang et al. | 482/133 |
| 5,743,838 | 4/1998 | Willis | 482/124 |
| 5,906,566 | 5/1999 | Whitcomb | 482/130 |

*Primary Examiner*—Jerome W. Donnelly
*Attorney, Agent, or Firm*—Larson & Larson, P.A.; James E. Larson

[57] ABSTRACT

A curved plate is attached to the back of a couch together with a pair of inverted U-shaped bars projecting forwardly over a front surface of an upright cushion of the couch. A tension cord is attached at a bottom end to a tension clamp under the couch and at a top end to a bracket mounted to the curved plate. A push rod turns the tension clamp to remove tension on the tension cord and allow either shortening or lengthening of the tension cord. A body harness is attached via a retractable elastic cord to a ring on each of inverted U-shaped bars. An exerciser bends forward to move the elastic cords and cause resistance against abdominal and associated mid-section muscles.

7 Claims, 4 Drawing Sheets

COUCH EXERCISE APPARATUS

BACKGROUND OF THE INVENTION

This invention relates to an exercise apparatus. More particularly it refers to an exercise apparatus attached to a couch to permit a person to exercise while in a normal seated position.

U.S. Pat. No. 5,141,482 describes an exercise apparatus for use with a chair having an adjustable length strap with a friction buckle for attachment to the chair. A chest strap having an adjustable length fits around the chest of the exerciser and is connected to the chair strap with a pair of self-retracting elastic cords. While the exercise apparatus of U.S. Pat. No. 5,141,482 performs as intended it is not suitable for use with a couch or other soft cushioned seat.

SUMMARY OF THE INVENTION

The present invention provides an exercise device that can be successfully employed with a couch while the exerciser is in a seated position. The apparatus has a curved plate attached to the back of a couch. A pair of inverted substantially U-shaped bars are attached at a back end to the curved plate and project forward over a front surface of a couch upright cushion. A tension cord is attached at a bottom end to a tension clamp under the couch and at a top end to a bracket mounted on the curved plate. A push rod movable through a bore in the bracket permits turning of the tension clamp to release pressure on the tension cord. Rings on a front portion of each U-shaped bar attach to a harness around the exerciser via an elastic cord that extends and retracts as the exerciser bends forward and back on the couch.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
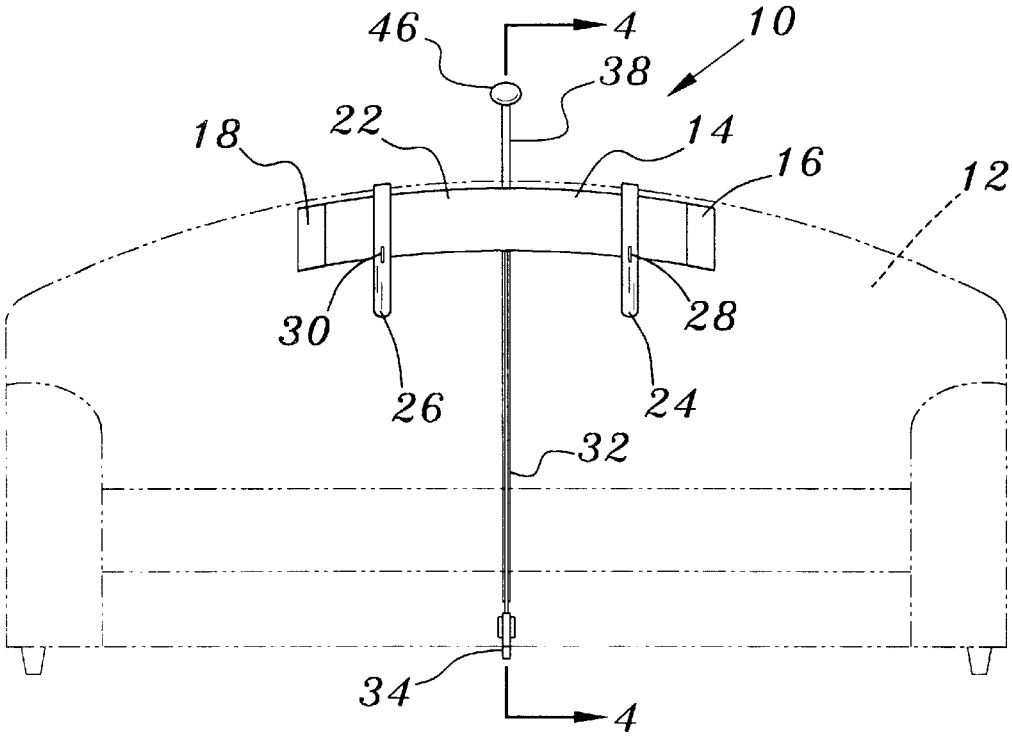
FIG. 1 is a front elevational view of the exercise apparatus of this invention mounted on a couch shown in phantom.
Figure 2:
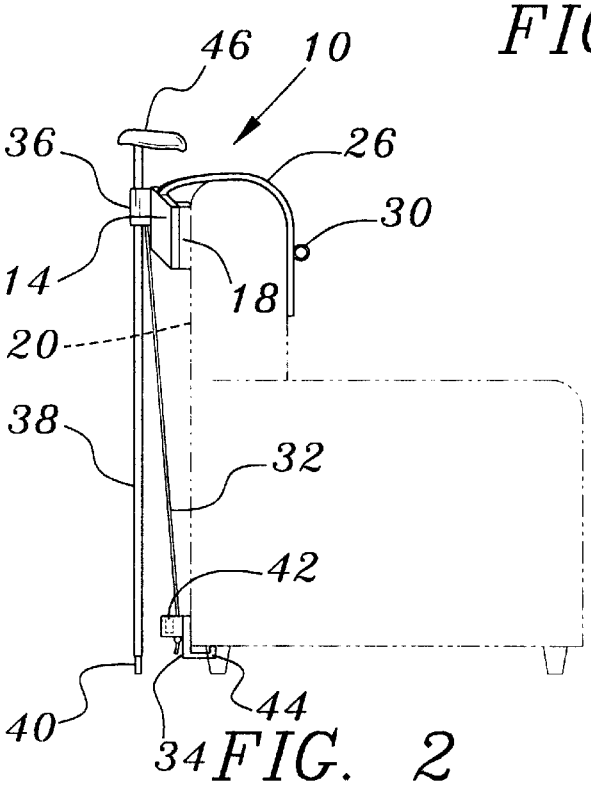
FIG. 2 is a side elevational view of the exercise apparatus mounted on a couch shown in phantom.
Figure 3:
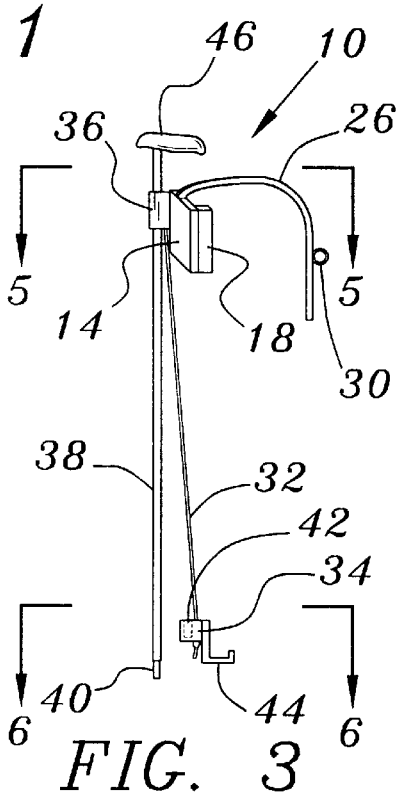
FIG. 3 is a side elevational view of the exercise apparatus.

Throughout the following detailed description the same reference numerals refer to the same elements in all figures. The exercise apparatus 10 shown in FIG. 1–3 is mounted over an upright portion of a couch 12. A curved back panel

14 has end pieces 16 and 18 that contact a back portion 20 of couch 12. The panel 14 middle portion 22 is spaced from the back portion 20 of couch 12. A pair of inverted substantially U-shaped arms 24 and 26 spaced apart are attached to the middle portion 22 of panel 14 and hang over a top portion of the couch 12. Rings 28 and 30 are located on a front portion of arms 24 and 26 respectively. These rings 28 and 30 are used to connect to the exerciser's body harness 52 to be discussed below.

A tension cord 32 is used to retain the back panel 14 and arms 24 and 26 in a firm position over couch 12. The tension cord 32 is attached at its bottom end to a tension clamp 34 and at a top end to a bracket 36 that also encloses a push rod 38.

Figure 4:
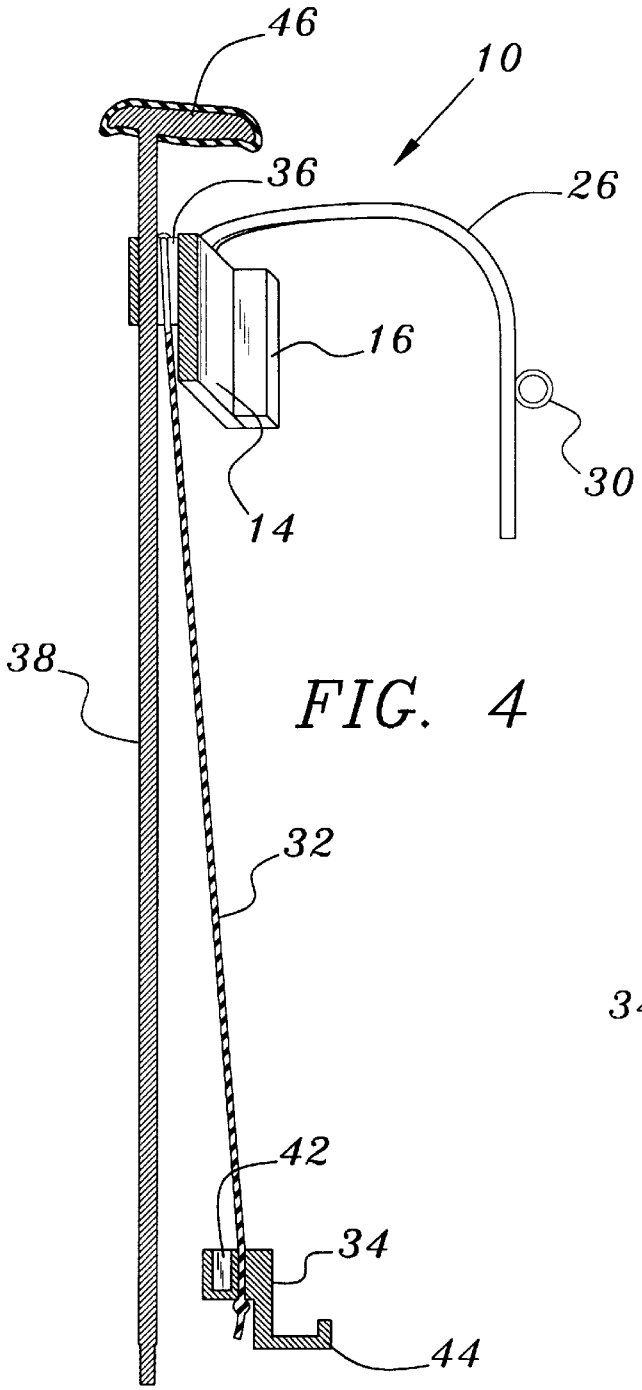
FIG. 4 is a sectional side elevational view along lines 4—4 of FIG. 1.
Figure 5:
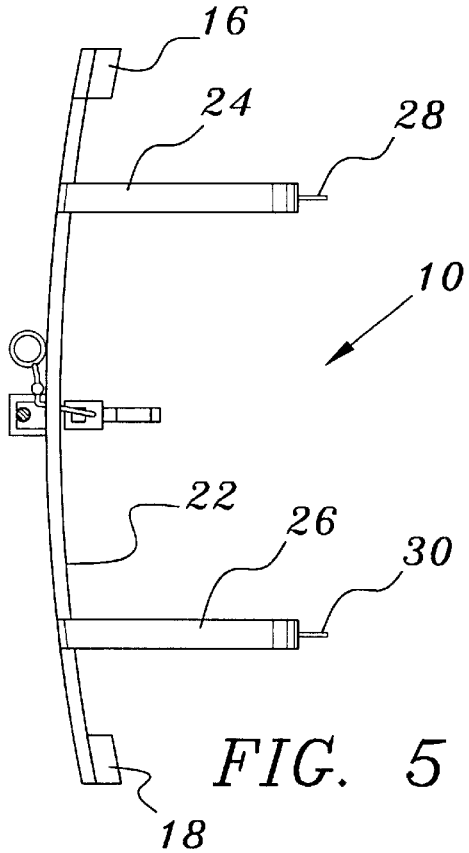
FIG. 5 is a top plan view of the exercise apparatus along lines 5—5 of FIG. 3.
Figure 6:
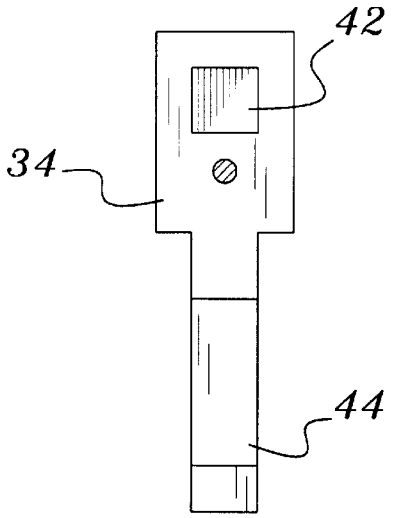
FIG. 6 is a top plan view of the tension clamp along lines 6—6 of FIG. 3.
Figures 7, 8:
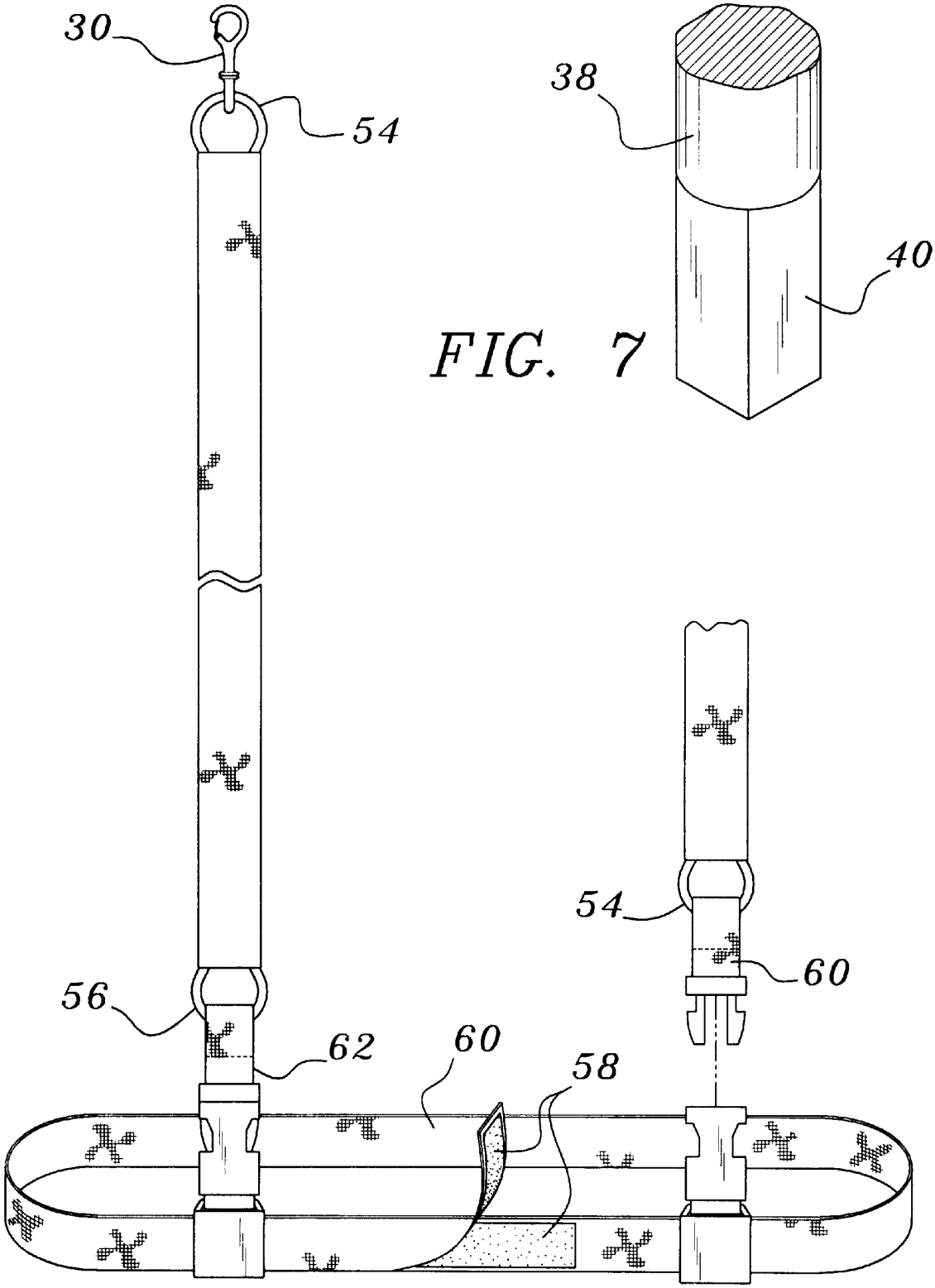
FIG. 7 is a perspective view of the bottom portion of a push rod.
FIG. 8 is a plan view of the harness strap connections used with the exercise apparatus.

The push rod 38, as seen in FIGS. 4 and 7, has a bottom portion 40 having a square geometry configured to fit into an orifice 42 on the tension clamp 34 as seen in FIG. 6. The tension clamp 34 has an L-shaped portion 44 which fits under couch 12 as seen in FIG. 2 and 4. By shortening tension cord 32 additional tension is exerted on the back panel 14 and the U-shaped arms 24 and 26. If the tension cord 32 is to be lengthened or shortened, the push rod 38 is grabbed at handle 46 and its bottom portion 40 is inserted into orifice 42. By turning and simultaneously pushing down on the push rod handle 46, the L-shaped portion 44 of the tension clamp 34 is pushed out from under the couch 12 and thereafter tension on the cord 32 is relieved.

Figure 9:
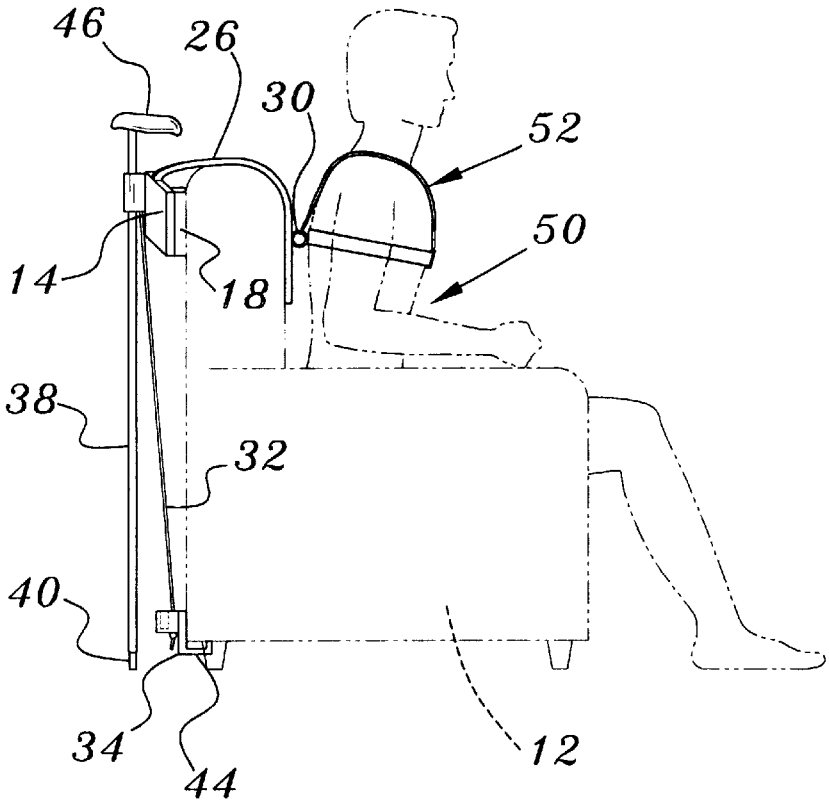
FIG. 9 shows in phantom a person sitting on a couch with the exercise apparatus attached in the resting position.
Figure 10:
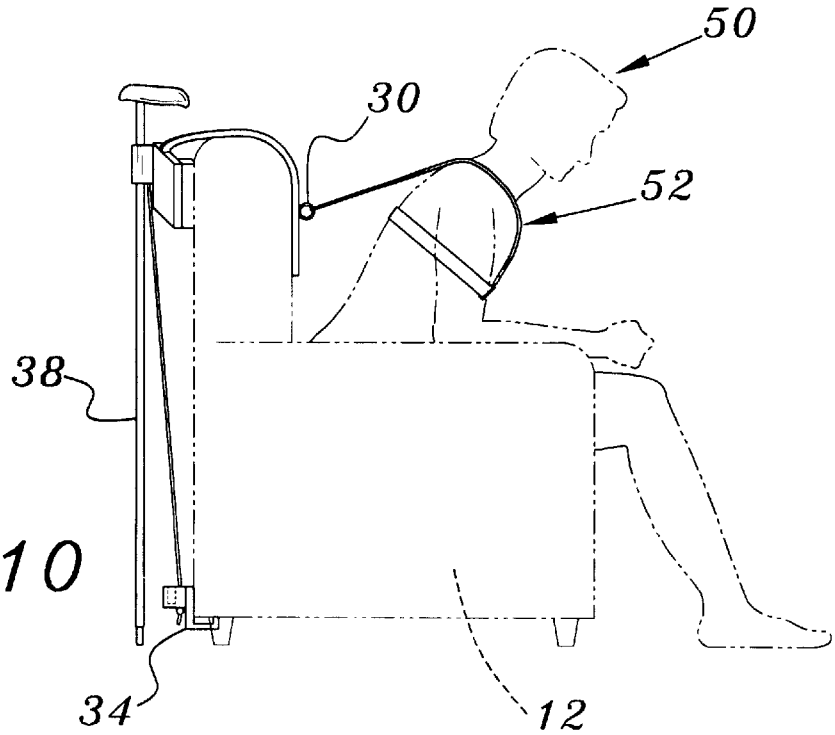
FIG. 10 shows in phantom an exercising person sitting on a couch with the exercise apparatus in use.

Turning to the use of the exercise apparatus 10 by an exerciser 50 sitting on a couch, reference is had to FIGS. 8–10. A harness 52 is strapped around the upper torso of the exerciser 50. The harness is attached to rings 28 and 30 via snap fastener 64. The snap fastener 64 is attached to first end 66 of a retractable tubing 62 inside of cords 54 and 56 as seen in FIG. 8. A second end 68 of the retractable tubing is attached to a mail connector 70 which engages a female connector 72 that engages a loop strap 74 around the front 60 of harness 52. Hook and loop material 58 attach a front portion 60 of the harness 52 around the chest of the exerciser. The cords 54 and 56 enclose a high strength self-retracting elastic material 62 such as used in bungee cords and are attached to the harness by connectors 70 and 72 at the end distal from the rings 28 and 30. The elastic material 62 within cords 54 and 56 is stretched under tension during a forward or side motion. This tension provides the exerciser with resistance against the body, notably the abdominal and associated midsection muscles.

Other harness arrangements for attachment to the rings 28 and 30 can be substituted to provide the same exercise function with the same result in the same way as the harness described herein.

Having described the above invention in detail, the following are my claims:

I claim:

1. An abdominal muscle exercise apparatus adapted for use by an exerciser sitting on a couch, the exercise apparatus comprising:

(a) a plate spaced apart by spacers from a rear portion of a couch, the plate attached to a pair of spaced apart inverted substnatially U-shaped arms overlapping a top portion of the couch;

(b) a harness attachment device located on a front surface of each inverted U-shaped arm;

(c) a bracket attached to a back surface of the plate;

(d) a tension cord attached at a top end to the bracket and at a bottom end to an L-shaped tension clamp;

(e) a push rod movable within a vertical bore in the bracket and having a bottom portion insertable in an orifice of the tension clamp so that pushing down on the push rod while simultaneously turning the push rod relieves tension on the tension cord and thereby on the plate and inverted U-shaped arms; and (f) a harness attached to the upper body of an exerciser and attached via retracting elastic straps to the harness attachment device on the U-shaped arms so that movement of the upper body of the exerciser exerts resistance against the exerciser's abdominal muscles.

2. An exercise apparatus according to claim 1 wherein the spacers are located at opposite ends of the plate.

3. An exercise apparatus according to claim 1 wherein the harness attachment device is a ring.

4. An exercise apparatus according to claim 1 wherein the bracket has two vertical bores, one to accommodate the push rod and one to accommodate the tension cord.

5. An exercise apparatus according to claim 1 wherein the harness has a pair of front straps to allow the exerciser to exit the harness, the pair of front straps joined together by hook and loop material.

6. An exercise apparatus mounted on an upright back portion of a couch, the exercise apparatus comprising:

(a) a plate conforming to a back shape of the couch spaced apart from a rear portion of the couch and attached to a pair of arms overlapping a top portion of the couch;

(b) a strap attachment ring mounted on a front surface of each arm distal from the plate;

(c) a bracket having a pair of vertical bores, the bracket attached to a back surface of the plates;

(d) an elastic cord passing through one of the bracket bores at a top end and attached at a bottom end to an L-shaped tension clamp;

(e) a push rod movable within one of the bracket vertical bores and having a bottom portion insertable in an orifice in the tension clamp so that pushing down on the push rod while simultaneously turning the push rod relieves tension on the tension cord; and (f) an upper body harness applied to the exerciser and attached via retracting elastic straps to the attachment ring on each arm so that movement of the exerciser's upper body exerts resistance against the exerciser's abdominal muscles.

7. An exercise apparatus according to claim 6 wherein spacers are located on opposite ends of the plate.

* * * * *